US005662128A

United States Patent [19]

Habibi

[11] Patent Number: 5,662,128

[45] Date of Patent: Sep. 2, 1997

[54] ADJUSTABLE HAIR CURLER AND METHOD OF USE

[76] Inventor: Masood Habibi, P.O. Box 71104, Los Angeles, Calif. 90071

[21] Appl. No.: 540,790

[22] Filed: Oct. 11, 1995

[51] Int. Cl.[6] ..... A45D 7/00

[52] U.S. Cl. ..... 132/210; 132/222; 132/247; 132/203; 132/223

[58] Field of Search ..... 132/210, 203, 132/247, 253, 245, 212, 222, 265, 248, 250, 223, 273

[56] References Cited

U.S. PATENT DOCUMENTS

| | | | |
|---|---|---|---|
| 3,232,300 | 2/1966 | Fisher | 132/39 |
| 3,590,829 | 7/1971 | Parisi | 132/43 |
| 4,270,555 | 6/1981 | Punte | 132/40 |
| 4,456,020 | 6/1984 | van Deursen | 132/34 |
| 4,524,788 | 6/1985 | Pauldine | 132/42 |
| 4,584,462 | 4/1986 | Morrison | 219/222 |
| 4,856,542 | 8/1989 | Hollenberg et al. | 132/265 |
| 5,000,200 | 3/1991 | Roberts | 132/245 |
| 5,020,552 | 6/1991 | Hollenberg et al. | 132/265 |
| 5,186,187 | 2/1993 | Roberts | 132/245 |

*Primary Examiner*—Gene Mancene
*Assistant Examiner*—Pedro Philogene
*Attorney, Agent, or Firm*—D'Alessandro & Ritchie

[57] ABSTRACT

The present invention is directed to a novel adjustable diameter hair curler which is extremely lightweight, portable, and suitable for travel. The novel adjustable curler includes a sheet of a flexible material such as a plastic or fabric or backing material. The sheet has a first planar side and a second planar side opposite said first planar side. Attached to the first side of the sheet are an array of hook-type elements from a hook and loop type fastening system such as VELCRO® brand hook and loop fasteners available from Velcro Industries of Manchester, N.H. The hook-type elements are generally arrayed over the bulk of the first side. Attached to at least a porion of the second side are loop-type fasteners or a material which will stick to the hook-type fasteners. By rolling the sheet to form a cylinder so that a portion of the sheet overlaps another portion of the sheet, the hook and loop fasteners may interact to hold the cylinder's shape with relative ease and complete adjustability of cylinder diameter. Lock-in of the shape may be accomplished easily with a single hand. For storage, the sheets may be completely flattened for storage or transport in a very minimal volume.

9 Claims, 4 Drawing Sheets

ADJUSTABLE HAIR CURLER AND METHOD OF USE

BACKGROUND OF THE INVENTION

1. Field of the Invention

The present invention relates to hair curlers for curling and setting the shape of human hair. More particularly, the invention relates to a novel adjustable apparatus for curling hair to selected diameter curls. The apparatus may be stored and carried in a small volume.

2. The Prior Art

Hair curlers are well known in the art. Such devices traditionally comprise a cylinder upon which hair is rolled or curled. Heat and/or hair spray or other hair products are often applied so that the hair takes on the shape of the curler and, when the curler is removed, the hair is still curled. It is often desirable to be able to adjust the diameter of a curler so that a small number of curlers may offer the capability of curling at a number of diameters. A number of adjustable diameter curlers are thus known in the art. U.S. Pat. No. 4,456,020 to van Deursen teaches an adjustable diameter curler. The van Deursen device comprises a pair of telescoping elongated tubes axially and rotatably movable relative to one another. A pair of nested larger diameter end caps is secured at each end of each tube with the roller generally resembling a spool. Each pair of end caps includes a first cap with spiralled cam slots radiating from its center and a second cap nested in the first with a plurality of corresponding or equal number of straight cam slots radiating from its center. The nesting caps are rotatable relative to each other and the caps at each end are connected together by a plurality of toothed elongated curler segments. Each segment has structure at each end cooperating with the cap slots such that by rotating the end caps in opposite directions the segments are radially cammed to change the curler roller diameter. Additional structure locks the cap rotation at any desired roller diameter.

U.S. Pat. No. 5,186,187 to Roberts teaches another adjustable diameter curler. Roberts' device provides for the use of a cylindrical tube rolled from a rectangular perforated sheet of flexible material, the sheet having an outer edge which overlaps a portion of the tube. The tube has a pair of opposing transverse edges, each of which is engaged within a spiral groove formed in opposing caps. The caps are rotationally mounted on an elongated shaft, such that rotation of the disks causes advancement of the transverse edges within the spiral groove, changing the diameter of the outer tube, as desired.

U.S. Pat. Nos. 5,020,552 and 4,856,542 to Hollenberg et al. teach a radially expandable hair curler comprising a generally cylindrical hollow body, a detachable holding strap stretching from one longitudinal end of the body to the other, and internal mechanical devices for expanding and contracting the curler body.

U.S. Pat. No. 4,270,555 to Punte teaches a hair curler that provides for a plurality of stages of hair curling with increasing wave lengths along the length of the hairs of the head. The hair curler may be used on short hair or very long hair. The multi-stages provide for a selectivity of lengths for short hair. The hair curler consists of a plurality of removably insertable curler components that nest one within the other in a manner similar to a telescoping mechanism. An elastic tie provides a means for securing the plurality of removably insertable components together and, at the same time, holds the hair in place on the curler. A port hole in one end provides a means for applying wave solution to the hair rolled on the interior of the roller, with communicating slots to permit the solution to seep through to the hair at the periphery of the spiraling rolls of hair.

U.S. Pat. No. 5,000,200 to Roberts provides for the use of a cylindrical tube rolled from a rectangular sheet of flexible material, the sheet having an outer edge which overlaps a portion of the tube. The tube has a pair of opposing transverse edges, each of which is engaged within a spiral groove formed in opposing end caps. The end caps are rotationally mounted on an elongated shaft, such that rotation of the caps causes advancement of the transverse edges within the spiral grooves, changing the diameter of the outer tube, as desired.

U.S. Pat. No. 3,232,300 to Fisher teaches an adjustable diameter hair curler formed of a sheet of soft plastic having an array of holes and a line of snap-type fasteners. The snaps mate with and penetrate a line of holes in the array to hold the sheet in the form of a cylinder. Diameter adjustment is accomplished by selecting another line of holes to apply the snaps to.

Non-adjustable fixed-diameter cylindrical hair curlers are known which include hook-type fasteners on the outer portion of the cylinder for engaging hair.

While the foregoing devices are fit for their intended purposes, there is room for improvement in portable, adjustable diameter hair curlers.

SUMMARY OF THE INVENTION

The present invention is directed to a novel adjustable diameter hair curler which is extremely lightweight, portable, and suitable for travel. The novel adjustable curler comprises a sheet of a flexible material such as a plastic. The sheet has a first planar side and a second planar side opposite said first planar side. Attached to the first side of the sheet are an array of hook-type elements from a hook and loop type fastening system such as VELCRO® brand hook and loop fasteners available from Velcro Industries of Manchester, N.H. The hook-type elements are generally arrayed over the bulk of the first side. Attached to at least a porion of the second side are loop-type fasteners or a material which will stick to the hook-type fasteners. By rolling the sheet to form a cylinder so that a portion of the sheet overlaps another portion of the sheet, the hook and loop fasteners may interact to hold the cylinder's shape with relative ease and complete adjustability of cylinder diameter. Lock-in of the shape may be accomplished easily with a single hand. For storage, the sheets may be completely flattened for storage or transport in a very minimal volume.

According to another aspect of the present invention, a receptacle and/or guide for a clip such as a bobby pin or hair clip is provided at one end of the sheet to aid in clipping or pinning hair to the curled sheet.

OBJECTS AND ADVANTAGES OF THE INVENTION

Accordingly, it is an object of the present invention to provide a novel hair curler.

It is a further object of the present invention to provide a novel hair curler which is completely adjustable in diameter, yet comprises no moving parts.

Yet a further object of the present invention is to provide an adjustable diameter curler which may be manipulated by a single hand.

These and many other objects and advantages of the present invention will become apparent to those of ordinary skill in the art from a consideration of the drawings and ensuing description of the invention.

DESCRIPTION OF THE PREFERRED EMBODIMENTS

Figure 1:
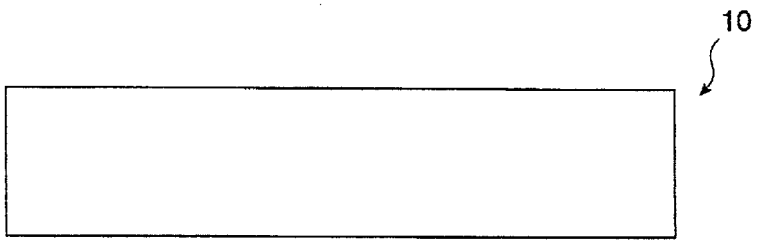
FIG. 1 is a top plan view of the adjustable curler according to a presently preferred embodiment of the present invention.

Those of ordinary skill in the art will realize that the following description of the present invention is illustrative only and is not intended to be in any way limiting. Other embodiments of the invention will readily suggest themselves to such skilled persons from an examination of the within disclosure.

The use of hair curlers to curl hair for cosmetic purposes is well known in the art. Such prior art curlers offer a number of drawbacks. When fixed diameter curlers are used, they are frequently voluminous to store or transport as a large number of curlers may be needed at any one time, and a complete set at each desired diameter may be required for full flexibility. Adjustable diameter curlers are often complex mechanisms which may be difficult to manipulate and which often do not store in a flat configuration so that storage in a small volume is possible. Such small volume storage is highly desirable for travel, or servicing customers away from the hair salon. The present invention resolves these drawbacks with elegant simplicity.

According to a presently preferred embodiment of the present invention, the adjustable curler comprises a thin flexible rectangular sheet 10 having hook-type fasteners 12 on a first planar side 14 and loop-type fasteners 16 (or an equivalent material to which hook-type fasteners will adhere) on the other or second planar side 18. Flexible sheet

Figure 2:
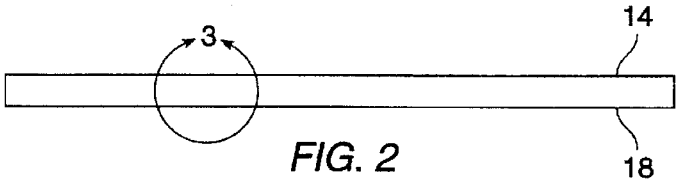
FIG. 2 is a side view of the adjustable curler according to a presently preferred embodiment of the present invention.
Figure 3:
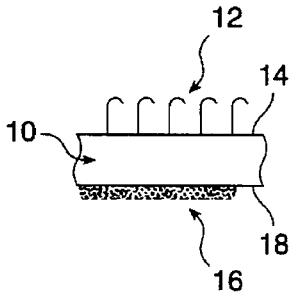
FIG. 3 is an enlarged view of the portion of FIG. 2 denoted with line 3 showing the hook and loop fastener system applied.

10 is preferably formed of a soft flexible plastic material of thickness less than about 0.25 inches, width preferably about 4 inches and length preferably about 12 inches. Different sizes may be used as desired. A cloth fabric material may also be used. The exact constitution of the sheet is unimportant as long as it may serve as a base for the hook and loop fasteners and provide some rigidity when coiled as shown in FIGS. 4–8. The backing material of model #90083 VELCRO® is suitable. For large diameter curlers, a flexible resilient plastic material may be used which tends toward its original flat shape. In this way, the curler will tend to a round cylindrical shape in use. In any event, the sheet material should be washable and water resistant. FIGS. 1, 2 and 3 show the basic configuration of this preferred embodiment. FIG. 1 is a top view, FIG. 2 is a side view, and FIG. 3 is an enlargement of a portion of FIG. 2 taken along line 3 and showing the hook and loop fasteners as applied.

In a preferred embodiment of the present invention, a hook-type material such as #90083 VELCRO® having a hook density of approximately 250–350 hooks per square inch is adhered to a first side 14 of sheet 10. Larger hooks, i.e., lower hook densities, may also be used. Smaller hooks are not preferred because they tend to tangle the hair. Since the curlers may need to be washed from time to time, if a chemical adhesive is used, it should not be soluble in water. Hot melt glues, epoxies and similar permanent chemical adhesives may be used to adhere the hook-type material to sheet 10. Similarly, loop-type material needs to be permanently adhered to second side 18 of sheet 10.

There is no requirement that sheet 10 be rectangular, although it is a convenient shape. There is no requirement that loop-type fasteners 16, or material to which hook-type fasteners will adhere, be disposed over the entirety of the second surface 18 of sheet 10, although this arrangement may be convenient and easily manufactured.

Figure 4:
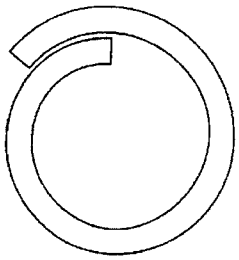
FIG. 4 is a view looking down the cylindrical form of the adjustable diameter hair curler according to a presently preferred embodiment of the present invention.
Figure 5:
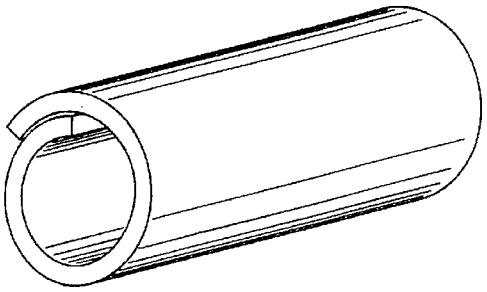
FIG. 5 is a perspective view of the cylindrical form of the adjustable diameter hair curler according to a presently preferred embodiment of the present invention.

According to the present invention the diameter of the curler may be set by manipulating the sheet 10 in a single hand to form a cylindrical shape with the hook-type fasteners 12 on the outside of the cylinder as shown in FIGS. 4 and 5. While a second hand may also be used, a major advantage of this invention is the ability to set the curler diameter with one hand, using the other hand to secure or hold something else. In this manner, speed of use is enhanced as well as providing enhanced ease of using the curlers.

Figure 6:
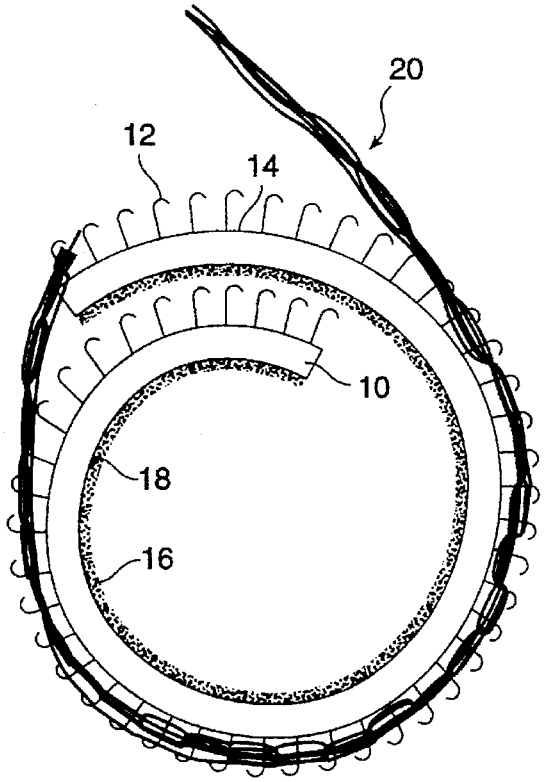
FIG. 6 is a side view of the cylindrical form of the adjustable diameter hair curler according to a presently preferred embodiment of the present invention showing hair wrapped around it as it would be in use.

Once the curler diameter is set, hair 20 may be rolled about the curler as shown in FIG. 6. Conventional bobby pins, hair clips and the like may be used to further attach hair to the curler, as desired. When done, the curlers may be disassembled to their flat states and stored in a very small volume.

Figure 7:
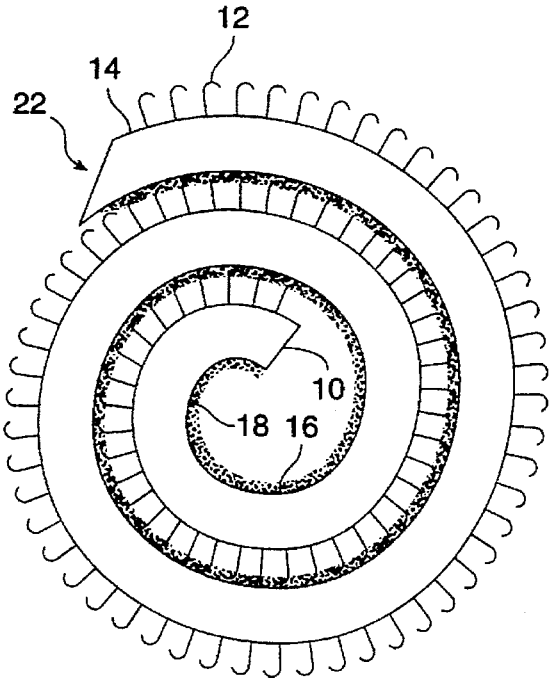
FIG. 7 is a side view of the cylindrical form of the adjustable diameter hair curler according to another preferred embodiment of the present invention showing hair wrapped around it as it would be in use and including a tapered portion.

Referring now to FIG. 7, in another preferred embodiment of the present invention, side 14 may be tapered to meet or approach side 18 as shown at taper 22. In this way, bumps or discontinuities due to the overlap of sheet 10 with itself at the outermost edge will be minimized and not imprinted on the hair 20 (FIG. 6).

Figure 8:
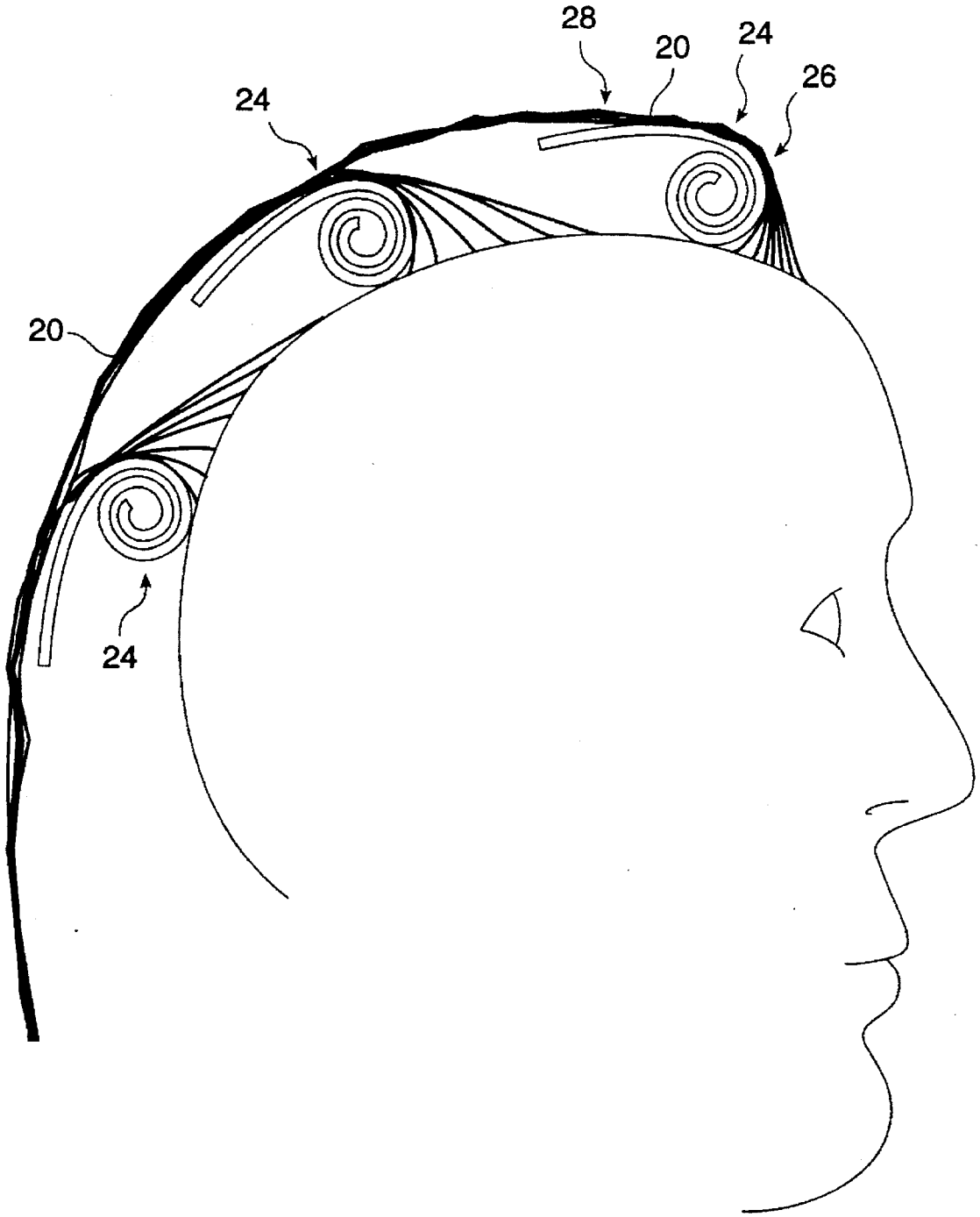
FIG. 8 is a view showing an alternative method of use of the adjustable diameter hair curler according to another preferred embodiment of the present invention showing hair pulled up by the curler and draped over a tail portion of the curler.

Turning now to FIG. 8, the present invention may be used in a novel way to achieve a novel effect. The adjustable curlers 24 may be configured as shown in FIG. 8 so that they comprise a rounded portion 26 and a tail 28. This configuration provides for lifting the hair against the roots while the tail keeps the hair straight, resulting in full hair with straight ends. Conventional round curlers curl the entirety of the hair and are not generally used where straight hair is desired.

Figure 9:
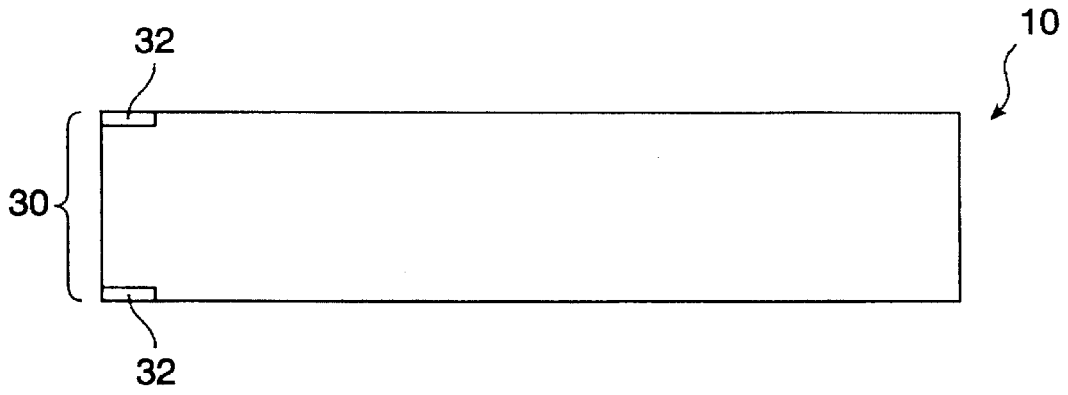
FIG. 9 is a top plan view of an alternative embodiment of the adjustable curler according to the present invention.
Figure 10:
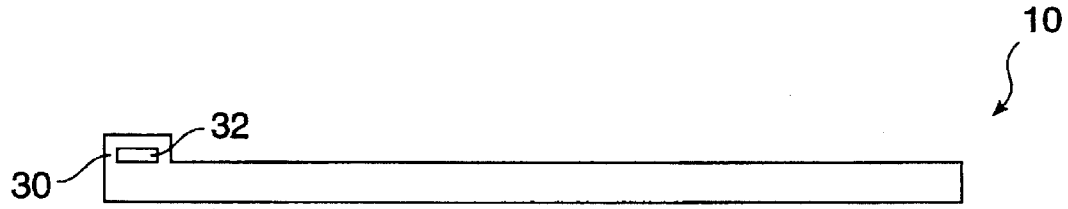
FIG. 10 is a side view of the alternative embodiment of FIG. 9 according to the present invention.
Figure 11:
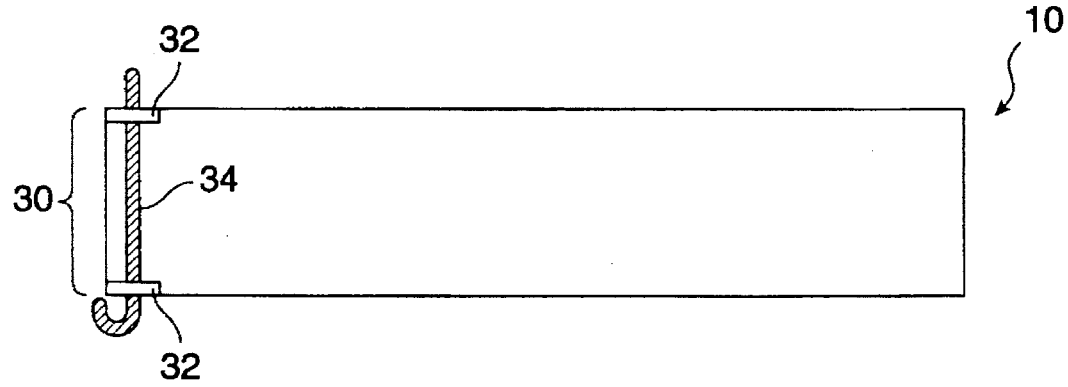
FIG. 11 is a top plan view of the alternative embodiment of FIG. 9 showing a bobby pin in place according to the present invention.

An alternative embodiment of sheet 10 is shown in FIGS. 9–11. According to this embodiment, a receptacle 30 is provided at one end of sheet 10 and is preferably formed of a pair of loop-shaped projections 32 which may act to retain and/or guide a pin or clip such as a bobby pin 34 which may be used to hold hair against sheet 10.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. An adjustable diameter hair curler comprising:

a thin sheet formed of a flexible material, said sheet having a first planar side and a second planar side;

an array of a plurality of hook-type fasteners disposed on and substantially covering all of said first planar side; and a material to which said hook-type fasteners will releasably adhere disposed on and substantially covering all of said second planar side.

2. An adjustable diameter hair curler according to claim 1 wherein said array of a plurality of hook-type fasteners has a density of less than or equal to 350 hooks per square inch.

3. An adjustable diameter hair curler comprising:

a thin sheet formed of a flexible material, said sheet having a first planar side and a second planar side;

an array of a plurality of hook-type fasteners disposed on and substantially covering all of said first planar side; and a material to which said hook-type fasteners will releasably adhere disposed on and substantially covering all of said second planar side;

said sheet formable into a cylindrical shape having an adjustable diameter with at least a plurality of said hook-type fasteners projecting outwardly from said cylindrical shape.

4. An adjustable diameter hair curler according to claim 3 wherein said array of a plurality of hook-type fasteners has a density of less than or equal to 350 hooks per square inch.

5. An adjustable diameter hair curler according to claim 3 further comprising at least a pair of loop-shaped projections disposed at one end of said thin sheet and protruding from one of said first and second planar sides so as to receive a clip and secure said clip to said thin sheet.

6. An adjustable diameter hair curler according to claim 4 further comprising at least a pair of loop-shaped projections disposed at one end of said thin sheet and protruding from one of said first and second planar sides so as to receive a clip and secure said clip to said thin sheet.

7. A method for applying hair to an adjustable diameter curler wherein said adjustable diameter curler includes a flat sheet of flexible material, one side of said flat sheet having hook-type fasteners disposed over substantially all of said one side and a second side of said flat sheet having loop-type fasteners disposed over substantially all of said second side, said method comprising the steps of:

rolling with one hand the sheet into a cylindrical shape with an overlap;

leaving at least a plurality of the hook-type fasteners projecting outwardly from the cylindrical shape;

causing with the same hand the hook and loop fasteners at the overlap to releasably adhere; and applying the hair about a longitudinal axis of the cylindrical shape to the hook-type fasteners projecting outwardly from the cylindrical shape.

8. A method for applying hair to an adjustable diameter curler wherein said adjustable diameter curler includes a flat sheet of flexible material, one side of said flat sheet having hook-type fasteners disposed over substantially all of said one side and a second side of said flat sheet having loop-type fasteners disposed over substantially all of said second side, said method comprising the steps of:

rolling said sheet with one hand into a shape including a cylindrical portion and a tail portion, the cylindrical portion including an overlap;

leaving at least a plurality of the hook-type fasteners projecting outwardly from the cylindrical portion and upwardly from the tail portion;

causing with the same hand the hook-type and loop-type fasteners at the overlap to releasably adhere; and applying the hair about a longitudinal axis of the cylindrical portion to the hook-type fasteners projecting outwardly from the cylindrical portion and lengthwise along the tail portion to the hook-type fasteners projecting upwardly from the tail portion.

9. A method according to claim 8, further comprising the following step:

clipping the hair to the curler at both said cylindrical portion and at said tail portion.

* * * * *